United States Patent [19]

Suzuki

[11] Patent Number: 5,034,772

[45] Date of Patent: Jul. 23, 1991

[54] HUMIDITY MEASUREMENT DEVICE AND IMAGE FORMING APPARATUS HAVING THE SAME

[75] Inventor: Koji Suzuki, Yokohama, Japan

[73] Assignee: Canon Kabushiki Kaisha, Tokyo, Japan

[21] Appl. No.: 534,365

[22] Filed: Jun. 5, 1990

Related U.S. Application Data

[63] Continuation of Ser. No. 245,632, Sep. 16, 1988, abandoned.

[30] Foreign Application Priority Data

| | | | |
|---|---|---|---|
| Sep. 25, 1987 | [JP] | Japan | 62-238950 |
| Sep. 30, 1987 | [JP] | Japan | 62-243863 |
| Sep. 30, 1987 | [JP] | Japan | 62-243864 |
| Nov. 4, 1987 | [JP] | Japan | 62-277355 |

[51] Int. Cl.[5] ..... G03G 15/02; G03G 15/01

[52] U.S. Cl. ..... 355/208; 355/214; 355/216; 355/225; 355/326

[58] Field of Search ..... 355/208, 214, 216, 221, 355/225, 326

[56] References Cited

U.S. PATENT DOCUMENTS

| | | | |
|---|---|---|---|
| 4,573,788 | 3/1986 | Nagashima et al. | 355/206 |
| 4,736,223 | 4/1988 | Suzuki | 355/4 |
| 4,888,618 | 12/1989 | Ishikawa | 355/208 |

FOREIGN PATENT DOCUMENTS 57-64263 4/1982 Japan .

*Primary Examiner*—R. L. Moses

*Attorney, Agent, or Firm*—Fitzpatrick Cella Harper Scinto

[57] ABSTRACT

An image forming apparatus includes an image forming unit for forming an image on a photosensitive drum, a surface potential measurement device for detecting a surface state of the photosensitive drum, a control for optimizing an operating condition of the image forming unit in accordance with a detection value from the surface potential measurement device and a target value, and a temperature/humidity (T.H.) measurement device for detecting an atmospheric condition within the image forming apparatus. The control selects the target value in accordance with a detection value from the T.H. measurement device.

12 Claims, 12 Drawing Sheets

HUMIDITY MEASUREMENT DEVICE AND IMAGE FORMING APPARATUS HAVING THE SAME

This application is a continuation of application Ser. No. 07/245,632 filed Sept. 16, 1988, now abandoned.

BACKGROUND OF THE INVENTION:

The present invention relates to an image forming apparatus with a humidity measurement device.

In an image formation apparatus such as an electrophotographic copying machine or a printer, it is very important to control image forming conditions and adjust an image density so as to obtain a high-quality image. According to a conventional method of adjusting an image density, a surface potential of a photosensitive body is detected to control image forming conditions such as a charging amount and an exposure amount, thereby correcting influences caused by an atmospheric change of the photosensitive drum and its deterioration of over time. According to another conventional method, atmospheric conditions and the number of copy cycles (prints) are measured to correct the image forming conditions.

However, the charging characteristics of a toner during, e.g., a developing process of an electrophotographic apparatus are greatly influenced by humidity A toner exposed in a low humidity condition provides an image density different from a toner exposed in a high humidity condition even if identical image forming conditions are given. For this reason, in a conventional image forming apparatus, it is difficult to optimally adjust an image density to obtain a high-quality image.

SUMMARY OF THE INVENTION:

The present invention has been made in consideration of the above situation, and has as its object to provide a humidity measurement device capable of highly precisely measuring humidity.

It is another object of the present invention to provide a compact humidity measurement device.

It is still another object of the present invention to provide an image forming apparatus which can optimize an image density without being adversely affected by changes in atmospheric conditions and deterioration over time.

It is still another object of the present invention to provide an image forming apparatus capable of compensating for image forming condition variations caused by changes in humidity.

It is still another object of the present invention to provide an image forming apparatus capable of optimally controlling a surface state of a recording medium regardless of changes in humidity.

The above and other objects, features, and advantages of the present invention will be apparent from the following detailed description in conjunction with the accompanying drawings.

Figure 1:
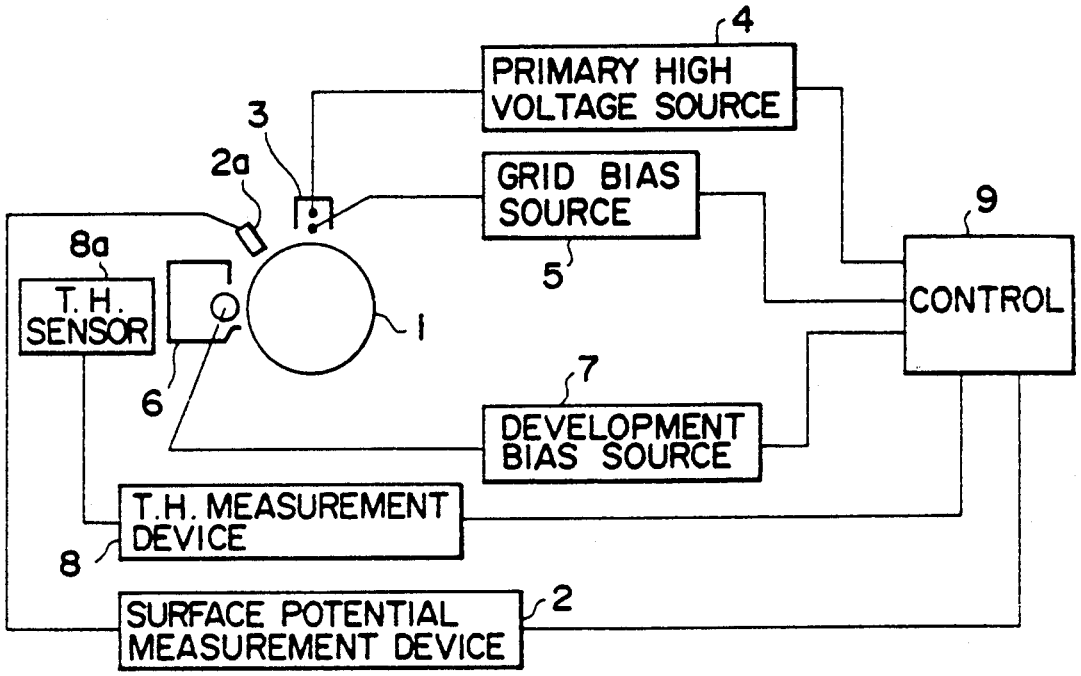
FIg. 1 is a schematic diagram of an image forming apparatus according to an embodiment of the present invention.
Figure 2:
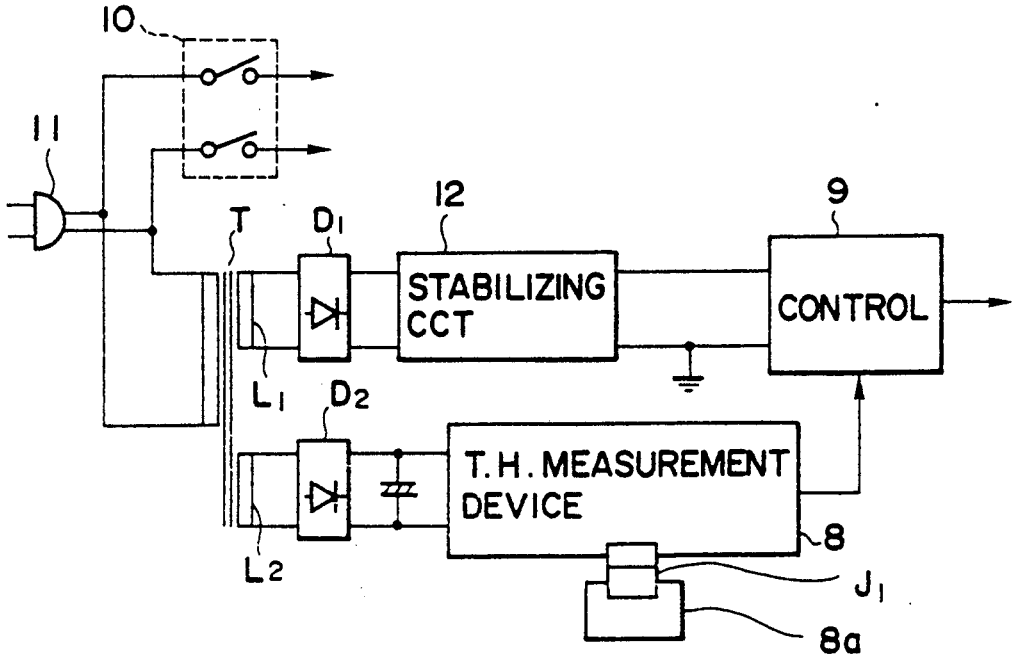
FIG. 2 is a diagram showing a temperature/humidity (T.H.) measurement device and a power source of a control in FIG. 1.

DETAILED DESCRIPTION OF THE PREFERRED EMBODIMENTS:

FIG. 1 is a block diagram showing a schematic arrangement of an image forming apparatus according to the present invention. The image forming apparatus includes a photosensitive drum 1, a surface potential measurement device (first detecting means) 2, a primary charger 3, a developing unit 6, a temperature/humidity (T.H.) measurement device (second detecting means) 8, and a control 9. The surface potential measurement device 2 detects a surface state of the photosensitive drum 1. More specifically, a potential $V_L$ of a bright portion on the photosensitive drum 1 and a potential $V_D$ of its dark portion are measured by using a detection signal from a surface potential sensor 2*a*. The primary charger 3 is biased by a primary high voltage source 4. A grid voltage of the primary charger 3 is controlled by a grid bias source 5 such that contrast ($V_D$–$V_L$) is converged to a target value. The developing unit 6 is biased by a development bias source 7. The T.H. measurement device 8 measures a temperature and a humidity near the developing unit in accordance with a detection signal from a T.H. sensor 8*a*, thereby detecting the atmospheric conditions within the image forming apparatus. The target value is selected in accordance with an output from the T.H. measurement device 8. The control 9 controls the image forming conditions in accordance with the measurement conditions of the above measurement devices. In other words, the control 9 controls a processing means for forming an image on the photosensitive drum 1. The control 9 comprises a microcomputer, and a control algorithm is stored in its memory.

A power source for the T.H. measurement device 8 and the control 9 is connected to a transformer T without being connected through a main switch 10. The transformer T has two windings $L_1$ and $L_2$. When the image forming apparatus is installed in position and a plug 11 is inserted into the receptacle, the transformer T is immediately energized. An output from the winding $L_1$ is rectified by a diode stack $D_1$ and is stabilized to a voltage of +5 V by a stabilizing circuit 12. The voltage of +5 V is applied to the control 9. An output from the winding $L_2$ is rectified by a diode stack $D_2$ and is applied as a voltage source of about +24 V to the T.H. measurement device 8. The T.H. measurement device 8 is connected to the T.H. sensor 8*a* through a connector $J_1$.

Figure 3A:
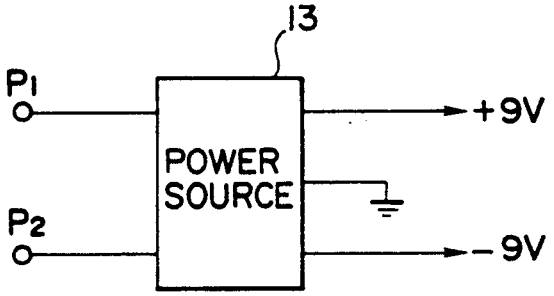
FIGS. 3A and 3B are block diagrams showing a basic arrangement of the T.H. measurement device.
Figure 3B:
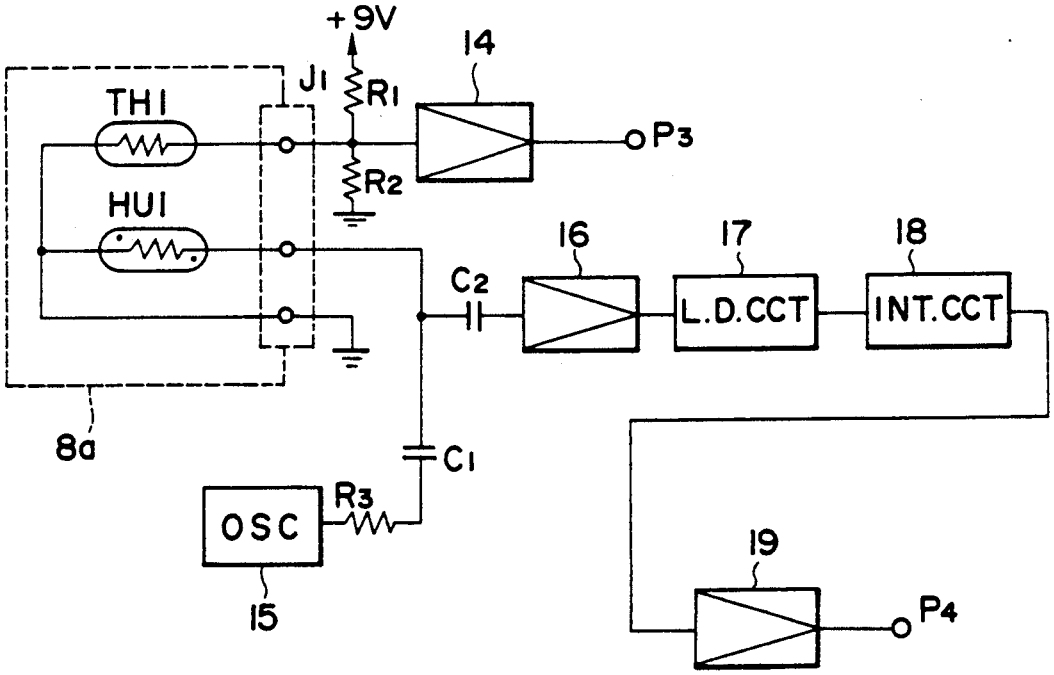

FIGS. 3A and 3B are block diagrams showing the basic arrangement of the T.H. measurement device 8. As shown in FIG. 3A, the voltage of about +24 V input from terminals $P_1$ and $P_2$ is transformed into voltages of +9 V and −9 V by a power source circuit 13, and these voltages are applied as bias voltage sources in the measurement circuit. The T.H. sensor 8*a* comprises a temperature sensor $TH_1$ of, e.g., a thermistor, and a polymer resistance output type humidity sensor $HU_1$. A bias voltage of +9 V is applied to the temperature sensor $TH_1$ through a resistor $R_1$. At this time, a resistor $R_2$ is connected in parallel with the sensor $TH_1$. A resistance of the resistor $T_2$ is set to correspond to an intermediate value in the temperature measurement range (0° to +50° C.) (i.e., the resistance of the sensor $TH_1$ at 25° C. is set at 10 kΩ). An output from the temperature sensor $TH_1$ is amplified by an operational amplifier 14 to a value falling within a predetermined voltage range. The amplified voltage is applied from a terminal $P_3$ to an input terminal of an A/D (analog/digital) converter in the control 9. An oscillation signal having a predetermined frequency and amplitude is supplied from an oscillator 15 to the humidity sensor $HU_1$ through a resistor $R_3$ and a capacitor $C_1$. A resistance of the resistor $R_3$ corresponds to a substantially intermediate value in the humidity measurement range. An output from the humidity sensor $HU_1$ is supplied to an operational amplifier 16 through a capacitor $C_2$ and is amplified to a value falling within the predetermined voltage range. The amplified voltage is converted into a high-precision DC signal by a linear detection circuit 17. This DC signal is smoothed by an integration circuit 18. The smoothed signal is processed by an operational amplifier 19 into a low-impedance signal. This signal is supplied from a terminal $P_4$ to the input terminal of the A/D converter in the control 9.

Figure 4A:
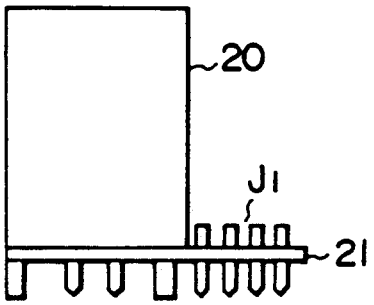
FIGS. 4A and 4B are views showing an outer appearance of the T.H. measurement device.
Figure 4B:
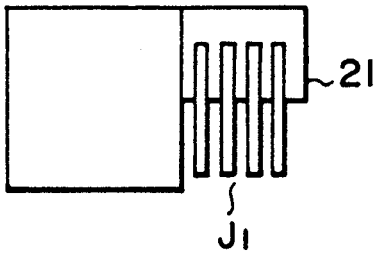
Figure 5:
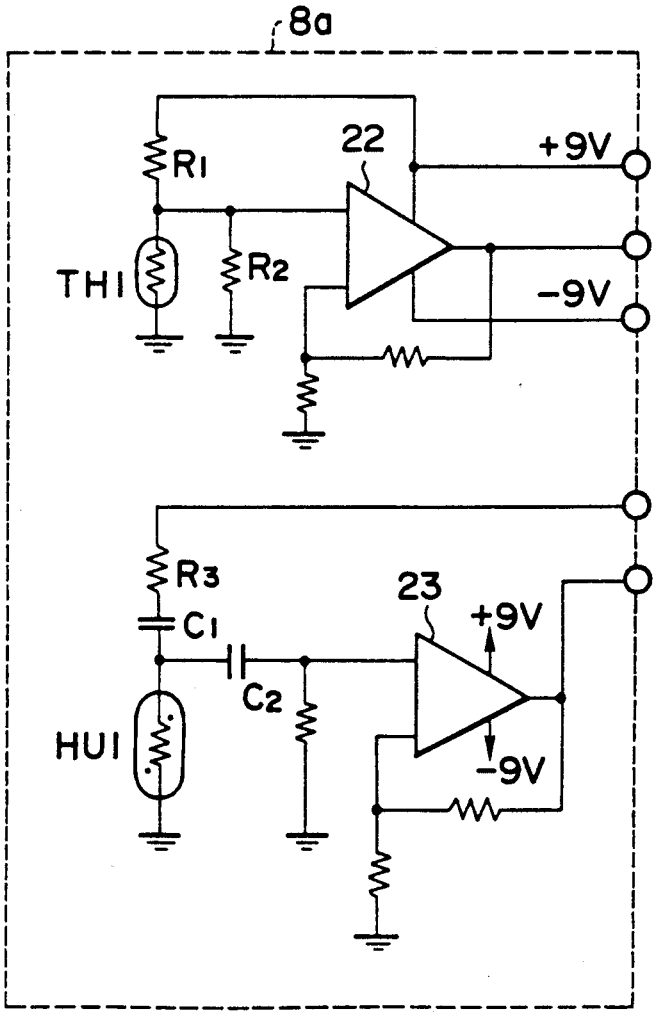
FIG. 5 is a circuit diagram showing an arrangement wherein an amplifier is arranged in a T.H. sensor.
Figure 6:
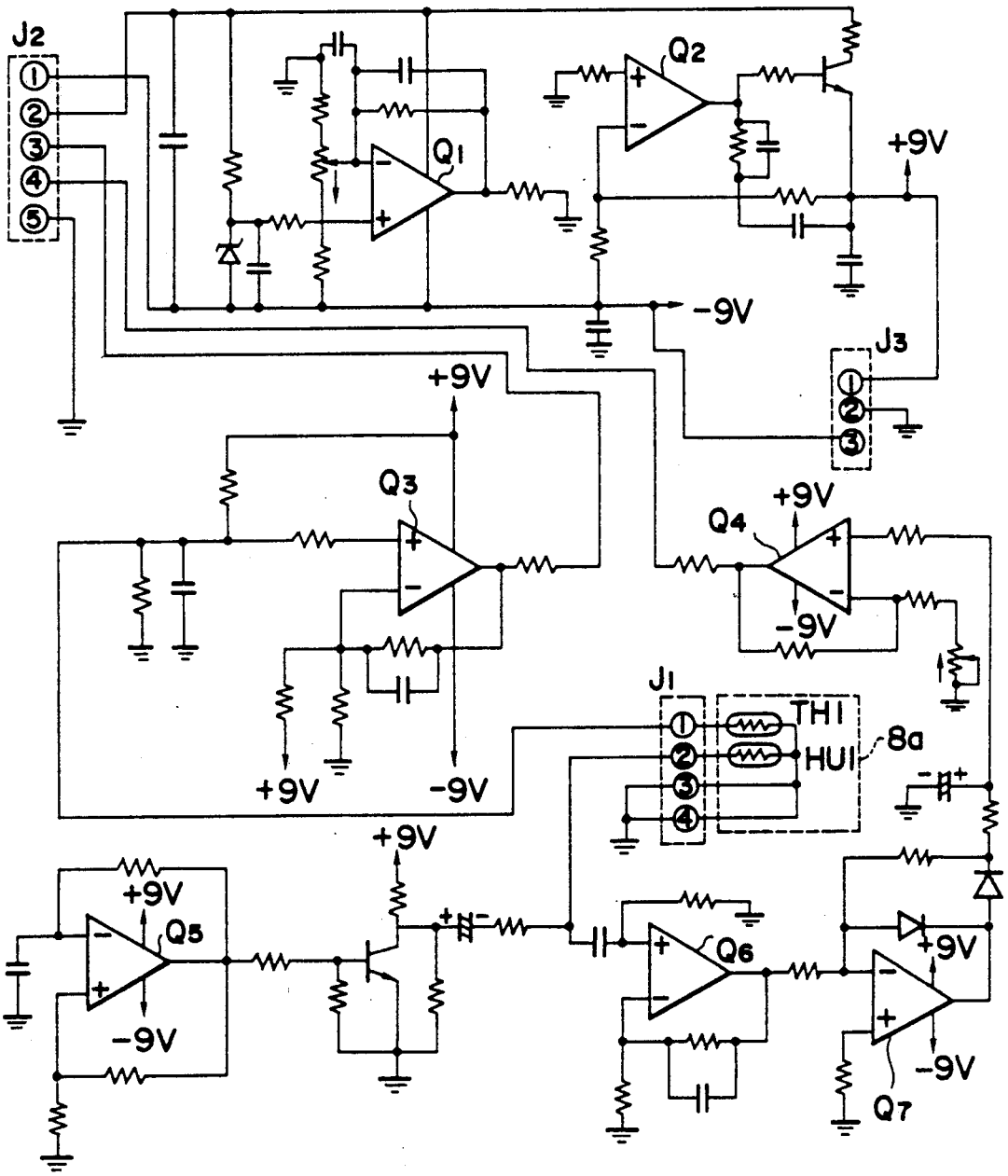
FIG. 6 is a circuit diagram of the T.H. measurement device.
Figure 7:
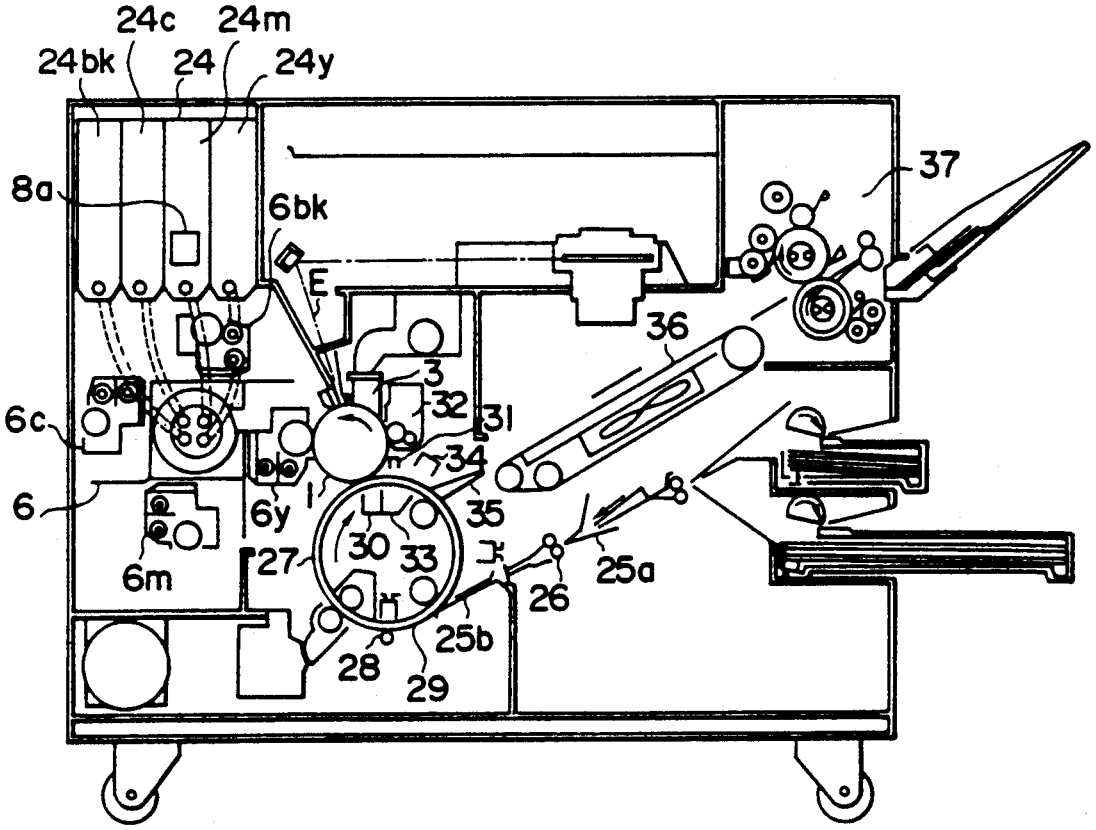
FIG. 7 is a view showing an overall arrangement of the image forming apparatus.

FIGS. 4A and 4B show an outer appearance of the T.H. sensor 8*a*, in which FIG. 4A is a front view thereof, and FIG. 4B is a plan view thereof. In the T.H. sensor 8*a*, the temperature sensor $TH_1$ and the humidity sensor $HU_1$ are covered with a dust-proof filter 20 and are mounted on a printed circuit board 21. The T.H. sensor 8*a* may be formed as a hybrid IC on a ceramic substrate by thick-film printing or soldering. Alternatively, as shown in FIG. 5, the sensor may include an amplifier, i.e., operational amplifiers 22 and 23 are integrally connected to the output terminals of the sensors $TH_1$ and $HU_1$. In this case, the sensor section can be separated from the measurement section, and therefore a mounting position of the sensor 8*a* can be optimally selected. In addition, calibration and maintenance of the sensor section can be facilitated. FIG. 6 is a circuit diagram of the T.H. measurement device 8 connected to the T.H. sensor 8*a* described above. The T.H. measurement device 8 includes connectors $J_1$ to $J_3$ and operational amplifiers $Q_1$ to $Q_7$ FIG. 7 shows an overall arrangement of an image forming apparatus with the T.H. measurement device described above. The image forming apparatus is a L 5 full-color printer. A yellow developing unit 6*y*, a magenta developing unit 6*m*, a cyan developing unit 6*c*, and a black developing unit 6*bk* are arranged in a rotary body of a developing unit 6. A developing agent (toner) replenishing unit 24 includes a yellow hopper 24*y*, a magenta hopper 24*m*, a cyan hopper 24*c*, and a black hopper 24*bk*.

An operation sequence of the overall color printer in a full-color mode will be briefly.described. The photosensitive drum 1 is rotated in a direction indicated by an arrow in FIG. 7 and is uniformly charged with the primary charger 3. The surface of the photosensitive drum 1 is irradiated with a laser beam E modulated by a yellow image signal according to an original (not shown). A latent image is formed on the photosensitive drum 1, and then developed by the yellow developing unit 6*y* located at the predetermined developing position.

A transfer sheet fed through a paper feed guide 25*a*, paper feed rollers 26, and a paper feed guide 25*b* is held by a gripper 27 synchronized with a predetermined timing signal The sheet is electrostatically wound around a transfer drum 29 by a contact roller 28 and its counter electrode. The transfer drum 29 is rotated in synchronism with the photosensitive drum 1 in a direction indicated by an arrow. A visible image obtained by the yellow developing unit 6y is transferred to the sheet by a transfer charger 30 at a predetermined transfer position. At this time, the transfer drum 29 continues to rotate so as to prepare for transfer in the next color (magenta in FIG. 7). The photosensitive drum 1 is discharged by a charger 31 and is cleaned by a cleaning member 32. The photosensitive drum 1 is charged by the charger 3 again. Magenta image exposure is then performed in accordance with a magenta image signal in the same manner as described above. Meanwhile, the developing unit 6 is rotated so that the magenta developing unit 6*m* located at the predetermined developing position performs magenta development. Subsequently, the above operations are repeated for cyan and black. When transfer operations of four colors are completed, four-color visible images on the transfer sheet are discharged by chargers 33 and 34. The gripper 27 is released, and the sheet is separated from the transfer drum 29 by a separation pawl 35. The separated sheet is transported to a fixing unit 37 through a conveyor belt 36. Therefore, a series of full-color printing operations are completed, and a desired full-color print image is formed.

The T.H. measurement device 8 is located near the developing unit in this embodiment. Image forming conditions are controlled in accordance with a measurement result of the T.H. measurement device 8. Therefore, the image density can be optimally controlled and a high-quality print can be obtained. Its control scheme will be described in detail below.

Figure 8:
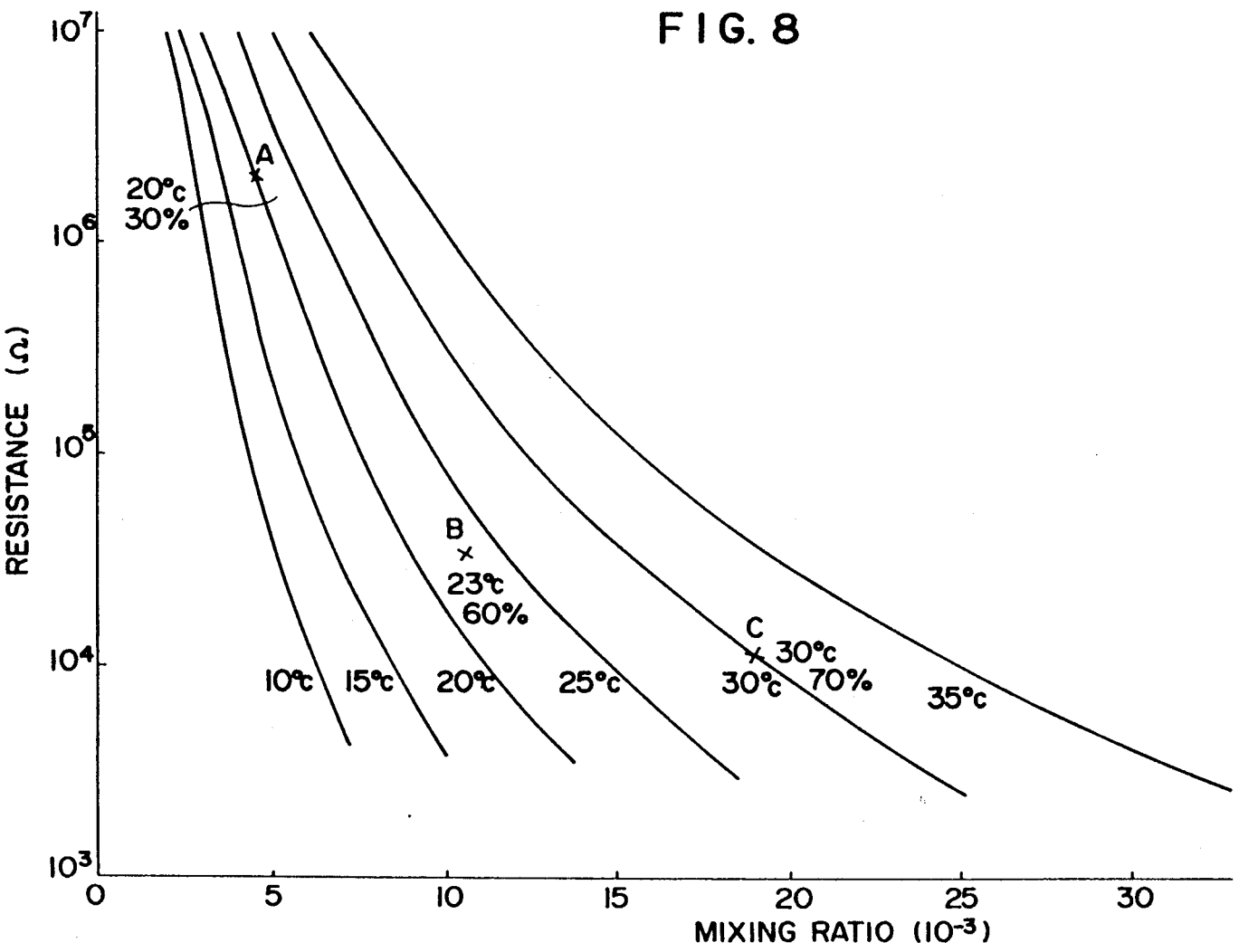
FIG. 8 is a graph showing characteristics of the T.H. sensor.

FIG. 8 is a graph showing characteristics of the humidity sensor $HU_1$ by using the humidity as a parameter. The mixing ratio of water vapor is plotted along the abscissa, and the resistance of the sensor $HU_1$ is plotted along the ordinate. A resistance (1 kΩ to 10 MΩ) is detected as a voltage (0 V to 5 V). Referring to FIG. 8, the A point represents a temperature of 20° C. and a relative humidity of 30%; the B point, 23° C. and 60%; and the point C, 30° C. and 70%.

Figure 9:
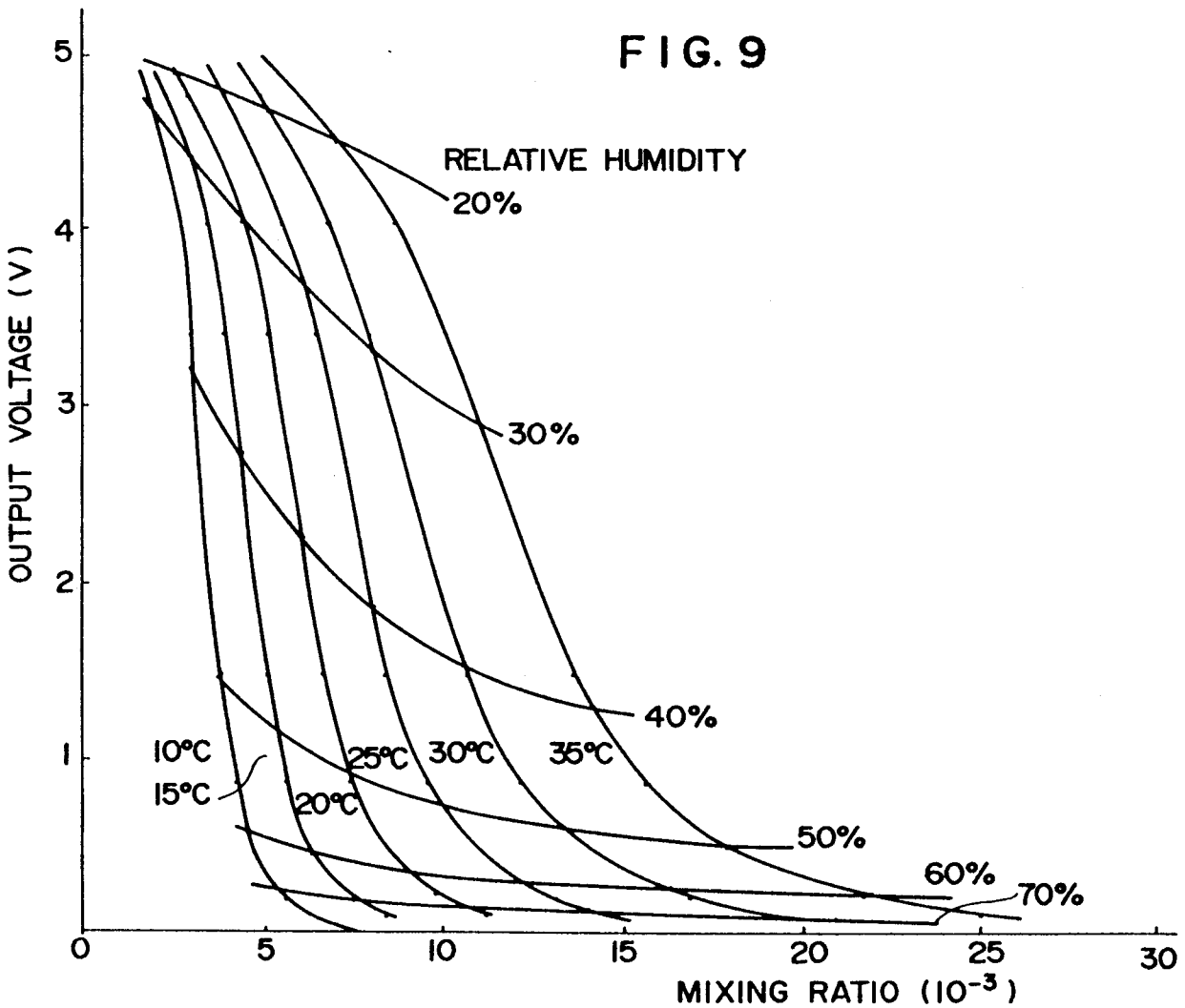
FIG. 9 is a graph showing temperature-humidity characteristics of the T.H. measurement circuit in the device shown in FIG. 3.

FIG. 9 is a graph showing temperature/humidity characteristics of the measurement circuit in FIG. 3 (FIG. 6). As is apparent from this graph, steep characteristic curves can be moderated by inserting the resistor $R_3$.

Temperature data (T) and humidity data (V) which are measured by the T.H. measurement device 8 are fetched by the microcomputer in the control 9. A mixing ratio E can be calculated by the following approximation on the basis of the input data as follows:

$$E = a_0T^3 + a_1 \cdot T^2 \cdot \frac{1}{V - b_1} + a_2T\left(\frac{1}{V - b_1}\right)^2 + a_3\left(\frac{1}{V - b_1}\right)^3 + \frac{a_4T^2}{V} + a_5\frac{T}{V^2} + a_6\frac{1}{V^3} + a_7T^2V + a_8TV^2 + a_9V^3 + \frac{a_{10}T}{V} + \frac{a_{10}T}{V - b_1} + a_{12}\left(\frac{1}{V - b_1}\right)^2 + a_{13}TV + a_{14}V^2 + a_{15}TV + a_{16}V^2 + \frac{a_{17}}{V - b_1} + \frac{a_{18}}{V} + a_{19}V + a_{20}$$

where $a_0$ to $a_{20}$, and $b_1$ are constants.

Figure 10:
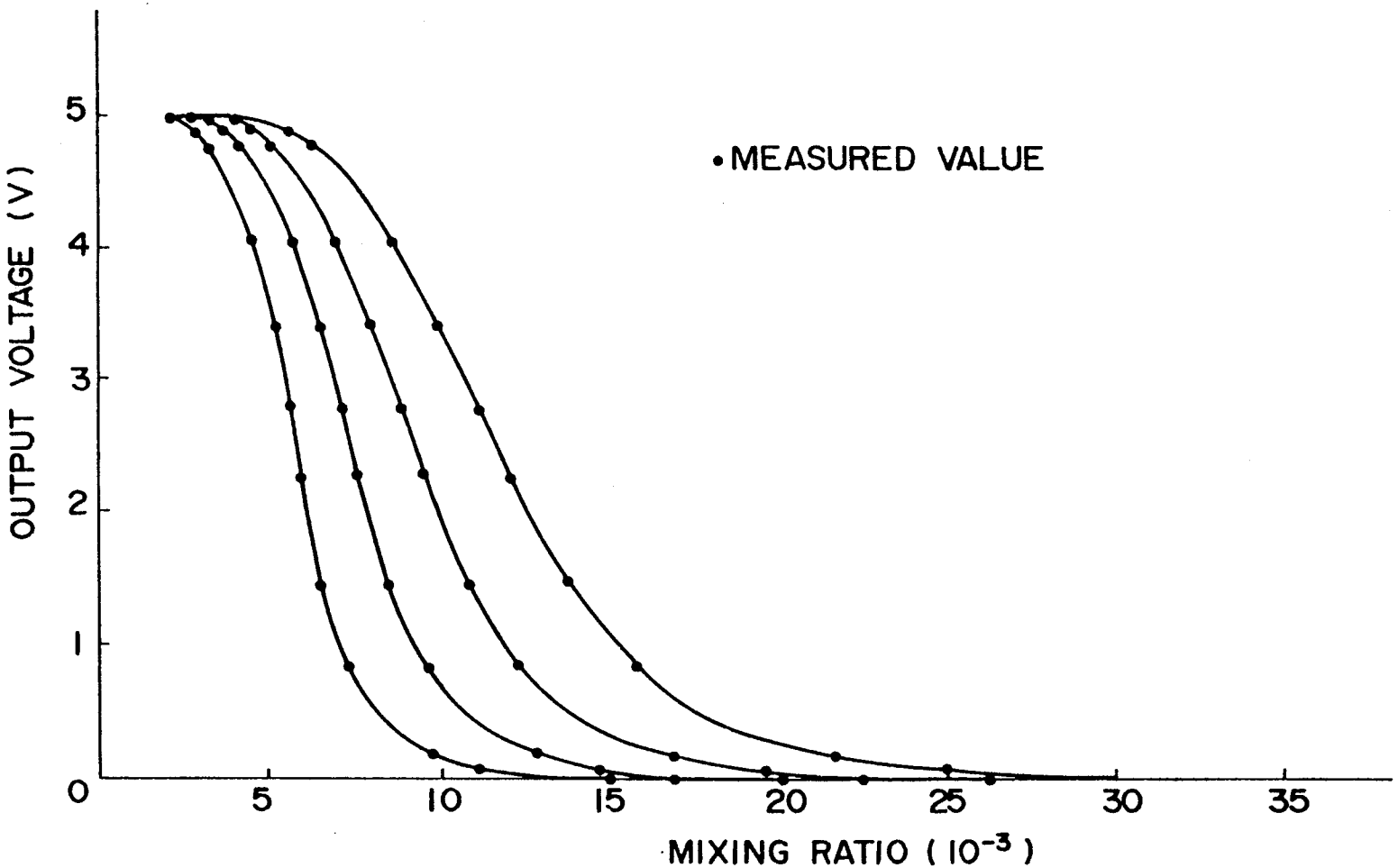
FIG. 10 is a graph showing characteristics representing approximation curves and measured values of mixing ratios.

FIG. 10 is a graph showing approximation curves obtained by the above approximation and the measured values. The solid curves are the approximation curves, and black dots represent the measured values. A method of correcting a contrast target value on the basis of the calculated mixing ratio will be described below. The mixing ratio data obtained as described above are extracted every 30 minutes, and mean values $X_0$, $X_2$, Xhd 4, and $X_8$ of the current measured value and the values on 2, 4, and 8 hours are obtained. A contrast ($Y_S$) is calculated using the above data $X_0$, $X_2$, Xhd 4, and $X_8$ as follows.

$$Y_S=\beta_1 Y_0-(\alpha_0X_0+\alpha_2X_2+\alpha_4X_4+\alpha_8X_8)$$

where $Y_0$ is a contrast predetermined value, and $\beta_1$, $\alpha_0$, o0, $\alpha_2$, $\alpha_4$, and $\alpha_8$ are weighting coefficients predetermined by six cases determined by magnitudes of the mean values $X_0$, $X_2$, $X_4$, and $X_8$. The resultant contrast ($Y_S$) serves as a contrast (y) target value obtained by the following surface potential measurement to control a grid voltage or the like. A contrast control equation by control of the grid voltage ($V_G$) is given as follows:

$$\Delta V_G=\gamma(Y_S-y)$$

where $\gamma$ is a predetermined value. The contrast target value is small when the humidity is high. However, the contrast target value is large when the humidity is low.

Both surface potential control and correction of the history of the previous atmospheres are used to perform high-precision image density control. In this case, the humidity and the temperature of a given position are measured, so that the mixing ratio can be obtained with high precision. In addition, humidity measurement in a wide range can also be performed.

Figure 11:
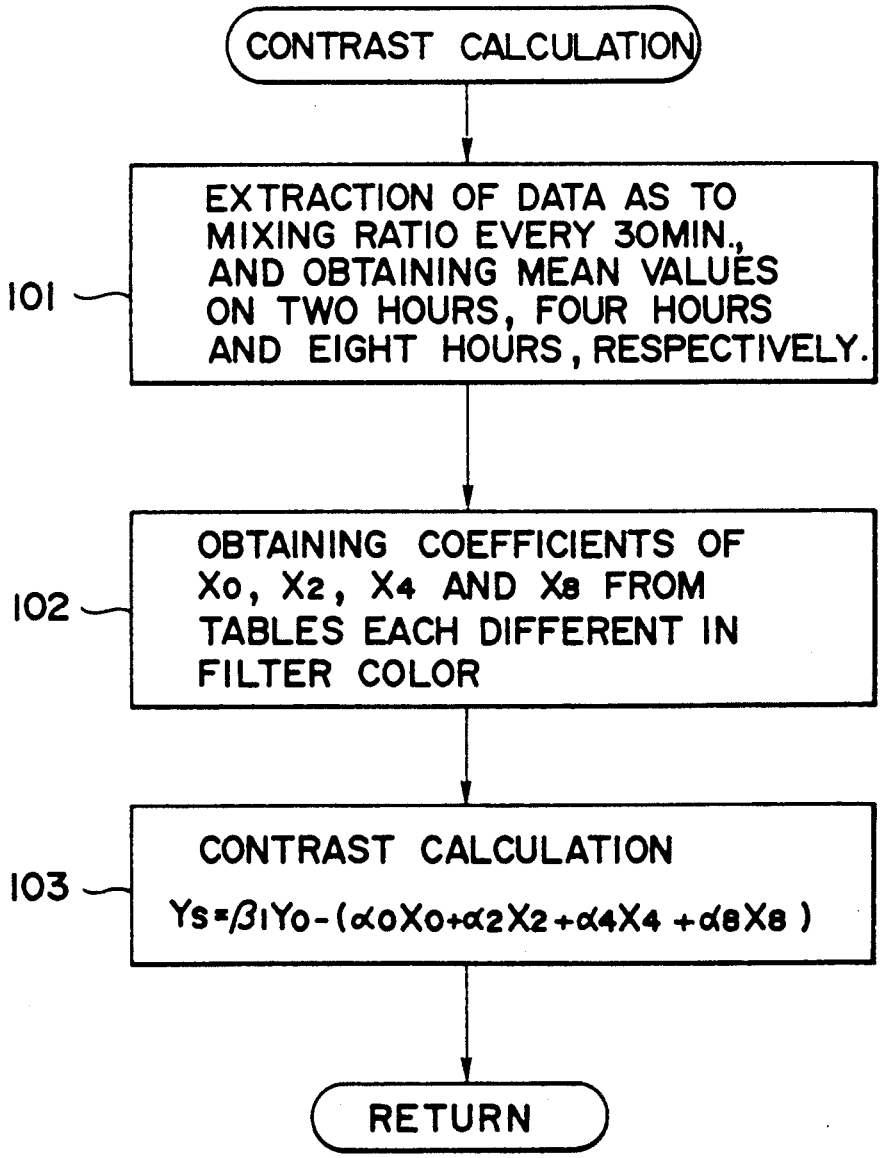
FIG. 11 is a flow chart for explaining a contrast calculation.

FIG. 11 is a flow chart for expaining a calculation of a contrast target value according to the mixing ratio. As described above, in step 101, the mean values $X_0$, $X_2$, $X_4$, and $X_8$ are calculated. In step 102, the coefficients $\beta_1$, $\alpha_0$, $\alpha_2$, $\alpha_4$, and $\alpha_8$ of the mean values are obtained from a table in the memory of the microcomputer. These coefficients are different in filter colors. In step 103, the contrast ($Y_S$) is calculated.

Figure 12:
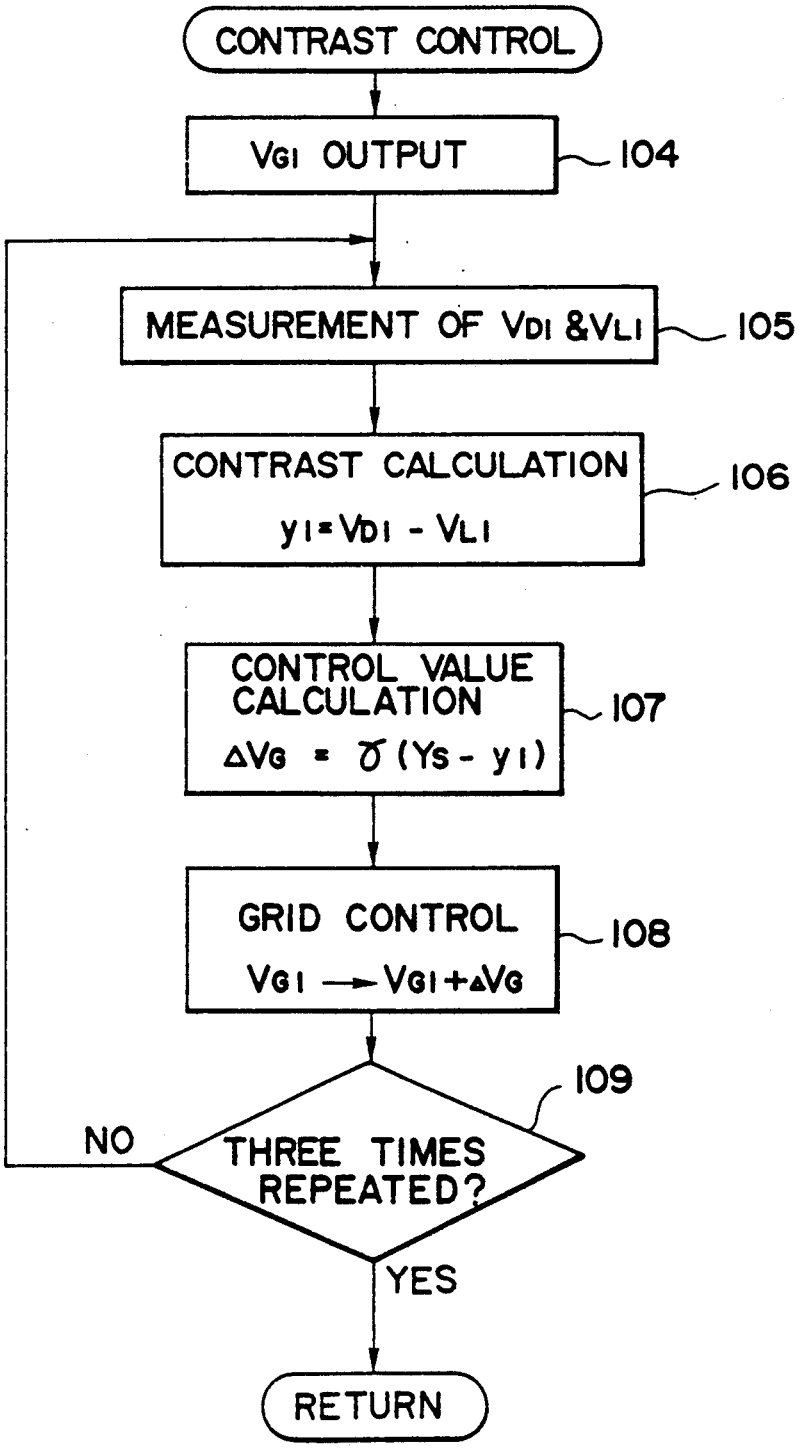
FIG. 12 is a flow chart for explaining contrast control.

FIG. 12 is a flow chart for explaining contrast control. In step 104, an initial value ($V_{Gl}$) of the grid voltage is output. In step 105, the potential $V_{L1}$ of the bright portion of the photosensitive drum 1 and the potential $V_{D1}$ of its dark portion are measured. A contrast is calculated on the basis of these measured values (i.e., $y_1=V_{D1}-V_{L1}$) in step 106. In step 107, a control value $\Delta V_G=\gamma(Y_S-y_1)$ of the grid voltage is calculated. In step 108, the grid voltage $V_{G1}$ is controlled to be a value added with the control value $\Delta V_G$. In step 109, the microcomputer determines whether the control cycle is repeated three times. If YES in step 109, the flow is ended. The variations in developing characteristics with respect to the changes in humidity can be perfectly compensated. At the same time, changes in atmosphere of the photosensitive drum 1 and its deterioration over time are corrected. The present invention is an indispensable technique in a pictorial color copying machine or printer which requires high-precision reproducibility of multiple gray scale levels.

Another embodiment of the present invention will be described below.

Figure 13A:
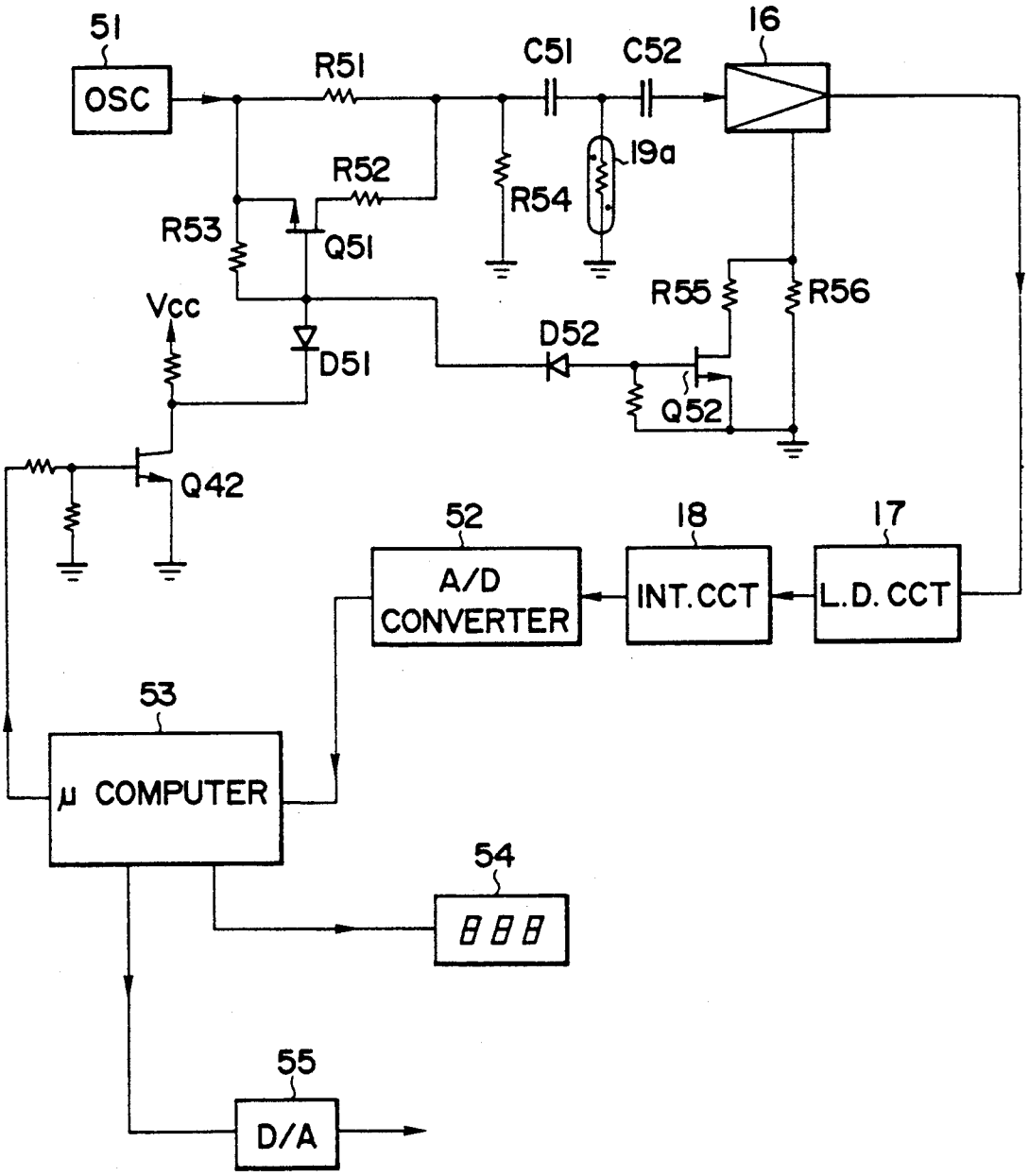
FIGS. 13A and 13B are diagrams showing T.H. measurement circuits according to other embodiments of the present invention, respectively.

FIG. 13A is a diagram showing a temperature/humidity (T.H.) measurement circuit according to this embodiment. The circuit has higher precision than that shown in FIGS. 3A , 3B and 5 and in a wider humidity range.

This circuit can perform humidity measurements from a state having a temperature of 10° C. or less and a relative humidity of 10% or less to a condition having a temperature 30° C. and a relative humidity of 90%. In a conventional logarithmic converter utilizing nonlinear voltage and current characteristics of a diode, high-precision logarithmic conversion is difficult to perform. In addition, logarithmic conversion using an approximation can perform high-precision conversion without any adjustment in accordance with the characteristics of the humidity sensor. However, when a measurement range is to be widened toward a lower humidity, selection of a resistor series-connected between the oscillator and the humidity sensor results in low measurement precision due to a decrease in S/N ratio at a higher humidity and an undesirable increase in resolution per bit. When the measurement range is to be widened toward a higher humidity, the characteristics are saturated at a lower humidity, thereby narrowing the low-humidity measurement range. In order to solve the above problem, two approximation relations are prepared in the microcomputer, and a resistance of the resistor series-connected between the oscillator and the sensor is automatically changed. A switch Q51 is used to change the series resistance and is controlled by a microcomputer 53. In a low-humidity measurement mode, the switch Q51 is turned off, and a series resistor is constituted by only a resistor R51 (5 MΩ). In this case, a resistor R54 has a high resistance of 100 MΩ or more.

In this state, the approximation relation for the characteristics of the series resistance of 5 MΩ is selected, as a matter of course. When a measured humidity output exceeds a damping region assigned in an intermediate region and enters a high-humidity region, the switch Q51 is turned on under the control of the microcomputer. At the same time, the approximation relation is switched to the one representing the characteristics of a series resistance corresponding to a parallel resistance (≈50 kΩ) of the resistor 51 (50 kΩ) and the resistor R52. A switch Q52 is switched synchronously with the switch Q51 to change a gain of an operational amplifier 16, thereby performing dynamic range matching. The circuit in FIG. 13A also includes resistors R53, R55, and R56, capacitors C51 and C52, diodes D51 and D52, a transistor Q42, a display unit 54 for displaying an output from the microcomputer 53, and a D/A converter 55 for converting an output from the microcomputer 54 into an analog signal.

According to this embodiment, the humidity measurement range can be greatly widened, and at the same time high-precision measurement can be performed.

In the embodiment shown in FIG. 13A, the two series resistances and the two control equations are selectively used. However, three or more series resistances and control equations may be used. In association with this, the number of control steps may be increased to simplify the approximation relation or to perform linear approximation.

An operation of the circuit shown in FIG. 13A will be briefly described. An output having a predetermined frequency and a predetermined ampitude from the oscillator 51 is input to a humidity sensor 8*a* through a plurality of input impedance circuits including the switch Q51 of an FET serving as a switching means and the resistors R51 and R52. The switch Q51 is switched by the microcomputer 53 in accordance with the low- and high-humidity measurement modes. For example, in the low-humidity measurement mode, the switch Q51 is opened so that the series resistance is constituted by the resistance of the resistor R51 and the approximation relation representing the characteristics of the series resistance of 5 MΩ is selected. However, when the output representing the measured humidity exceeds a damping region and enters a high-humidity region, the switch Q51 is turned on under the control of the microcomputer. The approximation relation is switched to the one representing the characteristics of the series resistance corresponding to the parallel resistance of the resistors R51 and R52. The switch Q52 is switched synchronously with the switch Q51, and the gain of the operational amplifier 16 is changed to perform dynamic range matching. An output from the humidity sensor 8*a* is amplified by the operational amplifier 16 serving as a high-input impedance amplifying means. An output from the operational amplifier 16 is rectified by a DC detection circuit 17 serving as a detecting means. An output from the DC detection circuit 17 is integrated by an integration (INT.) circuit 18 serving as an integrating means. An output from the integration circuit 18 is converted by an A/D converter 52 serving as an A/D conversion unit. A digital signal from the A/D converter 52 is input to the microcomputer 53 serving as the control, thereby compensating for the developing characteristics with respect to the humidity. Therefore, the measurement range around the developing unit can be greatly widened, and at the same time high-precision measurement can be performed.

Figure 13B:
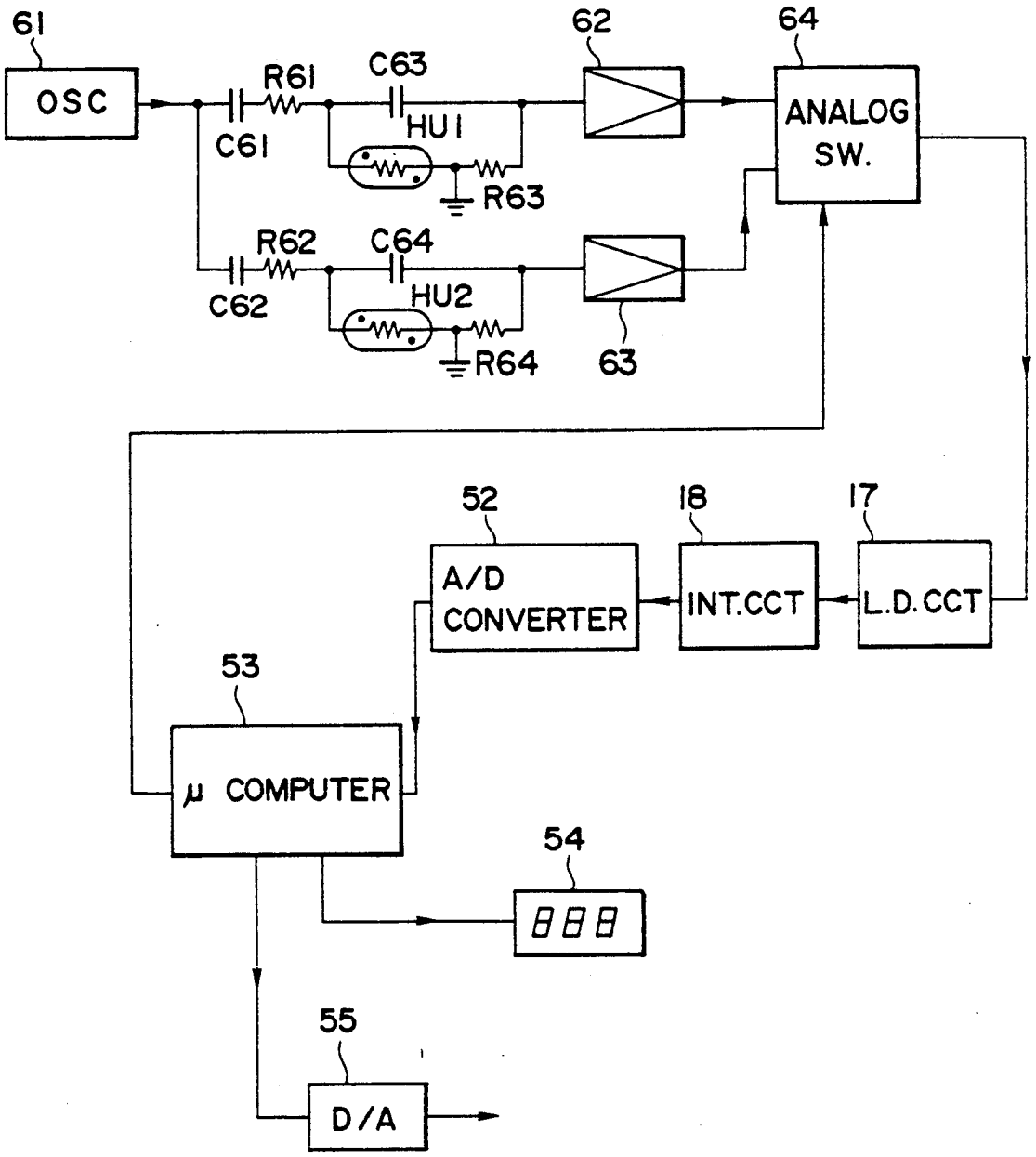

FIG. 13B is a diagram of still another embodiment of the present invention. A circuit in FIG. 13B has higher humidity measurement precision than that in FIG. 13A. A plurality of humidity sensors and a plurality of coupling circuits each for coupling an amplifier and an oscillator are used. Resistances of resistors R61 and R64 are selected in accordance with humidity measurement ranges. The resistances of the resistors R61 and R62 are set to be values corresponding to the sensor measurement values at intermediate hyumidity values in the humidity measurement ranges. The resistances of the resistors R63 and R64 are values corresponding to maximum resistances of the sensors in the humidity measurement ranges. The circuit in FIG. 13B includes humidity sensors $HU_1$ and $HU_2$, operational amplifiers 62 and 63, and an analog switch 64. The output from one of the humidity sensors is selected by the analog switch 64 in accordance with an instruction from the microcomputer 53.

The humidity can be highly precisely detected and the variations in developing characteristics with respect to the humidity can be compensated.

In each embodiment described above, contrast control is performed by the mixing ratio. However, contrast control may be made by controlling a relative or absolute humidity. An image forming condition such a DC value, an AC amplitude, or an AC frequency of the roller bias of the developing unit 6 may be controlled in place of control of the grid voltage of the primary charger 3. Alternatively, contrast control may be performed by controlling the transfer conditions.

The microcomputer may be the one which is used for sequence control.

What is claimed is:

1. An image forming apparatus comprising:

process means for forming a color image on a photosensitive body and for transferring the color image formed on said photosensitive body to a recording material;

first detecting means for detecting a surface state of said photosensitive body;

control means for optimizing for each color an operating condition of said process means in accordance with a detection value from said first detecting means and a target value; and second detecting means for detecting an atmospheric condition within said image forming apparatus, wherein said control means performs a predetermined calculation on the basis of an output from said second detecting means to obtain the target value for each color, and wherein prior to color image formation, said control means performs an optimizing operation in accordance with the target value obtained by said predetermined calculation and the detection value from said first detecting means.

2. An apparatus according to claim 1, wherein said first detecting means detects a surface potential of said photosensitive body.

3. An apparatus according to claim 2, wherein said control means calculates a contrast potential on the basis of potentials of bright and dark portions detected by said first detecting means and controls the operating condition of said process means so that the contrast potential comes close to the target value.

4. An apparatus according to claim 1 or 3, wherein said process means comprises charging means for charging sais photosensitive body, and said control means controls the operating condition of said charging means.

5. An apparatus according to claim 4, wherein said charging means comprises a grid, and said control means controls a voltage applied to said grid.

6. An apparatus according to claim 1 wherein said control means performs the operation on the basis of current and previous detection values from said second detecting means.

7. An apparatus according to claim 6, wherein said second detecting means detects a temperature and a humidity.

8. An image forming apparatus according to claim 1, wherein said second detecting means includes a sensor member, means for supplying to said sensor member an oscillating signal having a predetermined frequency, means for amplifying an output from said sensor member, and means for rectifying an output from said amplifying means.

9. An image forming apparatus comprising:

process means for forming a color iamge on a photosensitive body and transferring the color image formed on said photosensitive body to a recording material;

first detecting means for detecting a surface state of said photosensitive body;

control means for optimizing for each color an operating condition of said process means in accordance with a detection value from said first detecting means and a target value; and second detecting means for detecting an atmospheric condition within said image forming apparatus;

wherein said control means performs a predetermined calculation using a different parameter for each color on the basis of an output from said second detecting means to obtain the target value for each color, and wherein said control means performs an optimizing operation in accordance with the target value obtained by said predetermined calculation and the detection value from said first detecting means.

10. An image forming apparatus according to claim 9, wherein said second detecting means includes a sensor member, means for supplying to said sensor member an oscillating signal having a predetermined frequency, means for amplifying an output from said sensor member, and means for rectifying an output from said amplifying means.

11. An image forming apparatus comprising:

process means for forming a color image on a photosensitive body and transferring the color image formed on said photosensitive body to a recording material;

first detecting means for detecting a surface state of said photosensitive body;

second detecting means for detecting an atmospheric condition within said image forming apparatus; and control means for optimizing for each color an operating conditino of said process means in accordance with a detection output of said first detecting means and a detection output of said second detecting means;

wherein said control means determines for each color a target value on the basis of the detection output of said second detecting means, and determines for each color an operating condition of said process means in accordance with the target value for each color and the detection output of said first detecting means.

12. An image forming apparatus according to claim 11, wherein said second detecting means includes a sensor member, means for supplying to said sensor member an oscillating signal having a predetermined frequency, means for amplifying an output from said sensor member, and means for rectifying an output from said amplifying means.

* * * * *

UNITED STATES PATENT AND TRADEMARK OFFICE

CERTIFICATE OF CORRECTION

PATENT NO. : 5,034,772

DATED : July 23, 1991

INVENTOR(S) : KOJI SUZUKI

It is certified that error appears in the above-identified patent and that said Letters Patent is hereby corrected as shown below:

COLUMN 1

Line 9, "INVENTION:" should read --INVENTION--.
Line 28, "humidity A" should read --humidity. A--.
Line 36, "INVENTION:" should read --INVENTION--.
Line 61, "DRAWINGS:" should read --DRAWINGS--.
Line 63, "FIg. 1" should read --FIG. 1--.

COLUMN 2

Line 27, "EMBODIMENTS:" should read --EMBODIMENTS--.
Line 61, "wit-" should read --without--.
Line 62, "hour" should be deleted.

COLUMN 3

Line 64, "L 5" should be deleted.

COLUMN 4

Line 18, "signal The" should read --signal. The--.
Line 27, "FIG. 7). The" should read --FIG. 7). ¶ The--.

COLUMN 5

Line 13, "$\frac{a_{10}T}{V - b_1}$" should read --$\frac{a_{11}T}{V - b_1}$--.
Line 29, "Xhd 4," should read --$X_4$,--.
Line 31, "Xhd 4," should read --$X_4$,--.
Line 36, "oO," should be deleted.
Line 60, "values" should read --values--.

UNITED STATES PATENT AND TRADEMARK OFFICE

CERTIFICATE OF CORRECTION

PATENT NO. : 5,034,772

DATED : July 23, 1991

INVENTOR(S) : KOJI SUZUKI

It is certified that error appears in the above-identified patent and that said Letters Patent is hereby corrected as shown below:

COLUMN 6

Line 63, "resistor 51" should read --resistor R51--.

COLUMN 7

Line 63, "hyumidity" should read --humidity--.

COLUMN 8

Line 11, "such a" should read --such as a--.
Line 53, "sais" should read --said--.
Line 59, "claim 1" should read --claim 1,--.
Line 63, "claim 6," should read --claim 1 or 6,--.

COLUMN 9

Line 6, "iamge" should read --image--.

UNITED STATES PATENT AND TRADEMARK OFFICE

CERTIFICATE OF CORRECTION

PATENT NO. : 5,034,772

DATED : July 23, 1991

INVENTOR(S) : KOJI SUZUKI

It is certified that error appears in the above-identified patent and that said Letters Patent is hereby corrected as shown below:

COLUMN 10

Line 13, "conditino" should read --condition--.

Signed and Sealed this

Fourth Day of May, 1993

Michael K. Kirk

MICHAEL K. KIRK

*Acting Commissioner of Patents and Trademarks*

*Attest:*

*Attesting Officer*